US010054886B2

(12) United States Patent
Maeda et al.

(10) Patent No.: US 10,054,886 B2
(45) Date of Patent: Aug. 21, 2018

(54) FIXING DEVICE AND IMAGE FORMING APPARATUS THAT PREVENT LOCAL UNEVENNESS OF A PRESSURE FORCE

(71) Applicant: KONICA MINOLTA, INC., Chiyoda-ku, Tokyo (JP)

(72) Inventors: Hiroyuki Maeda, Toyokawa (JP); Miho Yamano, Kokubunji (JP); Dai Suwama, Hachioji (JP); Midori Shimomura, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/605,455

(22) Filed: May 25, 2017

(65) Prior Publication Data

US 2017/0343941 A1 Nov. 30, 2017

(30) Foreign Application Priority Data

May 26, 2016 (JP) ..... 2016-104763

(51) Int. Cl.
*G03G 15/20* (2006.01)

(52) U.S. Cl.
CPC . *G03G 15/2089* (2013.01); *G03G 2215/2009* (2013.01)

(58) Field of Classification Search
CPC ..... G03G 15/2064; G03G 15/2089; G03G 2215/2006; G03G 2215/2009
USPC ..... 399/329
See application file for complete search history.

(56) References Cited

U.S. PATENT DOCUMENTS 5,276,493 A * 1/1994 Hediger ..... G03G 15/2064 219/216
8,897,684 B2 * 11/2014 Fromm ..... G03G 15/2028 399/323
2003/0129007 A1 * 7/2003 Pirwitz ..... G03G 15/2053 399/328
2007/0071466 A1 * 3/2007 Condello ..... G03G 15/2064 399/45
2010/0303493 A1 * 12/2010 Hamby ..... G03G 15/2064 399/67

FOREIGN PATENT DOCUMENTS

JP 06308856 A * 11/1994
JP 09325640 A 12/1997
JP 2011048152 A * 3/2011

* cited by examiner

*Primary Examiner* — Robert Beatty
(74) *Attorney, Agent, or Firm* — Holtz, Holtz & Volek PC

(57) ABSTRACT

A fixing device includes a fixing roller heated to a predetermined temperature by a heater; a pressure belt in pressure contact with the fixing roller; and a pressing part which presses the pressure belt toward the fixing roller. The fixing device adopts a belt-nip system and fixes a toner image formed on a recording medium to the recording medium by heat and pressure while the recording medium is nipped and conveyed through a nip part. The nip part is formed by the fixing roller and the pressure belt and includes an adhesion nip and a separation nip. The pressing part includes a pressing member, a sheet member which covers the pressing surface of the pressing member along a conveying direction of the recording medium, and a pressing fluid which is filled at the adhesion nip between the pressing member and the sheet member.

11 Claims, 7 Drawing Sheets

| OPERATION INFORMATION | | LONGITUDINAL DISTANCE OF FLUID DISTRIBUTION CONTROL MEMBER,Y | LATERAL DISTANCE OF FLUID DISTRIBUTION CONTROL MEMBER,X |
|---|---|---|---|
| OPERATION | PAPER TYPE | | |
| PRINTING | THIN PAPER | Y1 | X1 |
| | NORMAL PAPER | Y2, >Y1 | X2, <X1 |
| | THICK PAPER, ENVELOPE | Y3, >Y2 | X3, <X2 |
| SEPARATION | | Y4, >Y3*1 | X4, ≥ X1 |

*1:Y4 IS LARGE ENOUGH TO SEPARATE PRESSING PART FROM FIXING ROLLER

FIXING DEVICE AND IMAGE FORMING APPARATUS THAT PREVENT LOCAL UNEVENNESS OF A PRESSURE FORCE

BACKGROUND OF THE INVENTION

1. Field of the Invention

The present invention relates to a fixing device and an image forming apparatus.

2. Description of Related Art

A conventional image forming apparatus of an electrophotographic system, such as a printer and a copying machine, develops a toner image on a photoreceptor drum on the basis of image data and transfers the toner image onto a recording medium, such as paper. Then, the image forming apparatus fixes the toner image by heat and pressure in a fixing device while the paper is nipped and conveyed through a nip part, and thereby forms an image on the paper. One known example of the fixing device is a fixing device adopting a belt-nip system, which brings an endless belt into pressure contact with a fixing roller, including a heater therein, to form a nip part by a pressure applying unit. This fixing device of the belt-nip system is advantageous because it can from a wide fixing nip in spite of compact size.

The nip part formed as above is constituted of a first nip at which the paper closely adhere to the fixing roller and a second nip at which the separation curvature of the fixing roller is large so as to enhance separation property of the paper and the fixing roller.

The first nip and the second nip may be formed as one pressure applying unit or as two separate pressure applying units.

However, due to variations in processing accuracy, for example, local unevenness of pressing force easily occurs at the boundary between the first nip and the second nip in the fixing device of the belt-nip system, and causes deteriorated image quality.

Considering the above, the fixing device of the belt-nip system using an endless belt according to JP H09-325640A has a pressure auxiliary pad having a heat-resistant elastic bag, which is charged with a heat-resistant liquid in a vacuum condition, and a low-friction sheet, which covers the elastic bag at the side facing the fixing roller. The pressure auxiliary pad is disposed inside of the endless belt and presses the endless belt toward a fixing roller at the contact surface of the endless belt with the outer periphery of the fixing roller. As a result, deterioration of a toner image by air or moisture in the belt-nip can be prevented even when the pressure auxiliary pad is long and wide (see JP H09-325640A).

According to the fixing device described in JP H09-325640A, however, a problem of local unevenness of pressing force may occur due to a gap formed at a very narrow region between the low-friction sheet and the elastic bag, which is charged with a heat-resistant liquid in a vacuum condition.

SUMMARY OF THE INVENTION

It is an object of the present invention to provide a fixing device and an image forming apparatus that do not cause local unevenness of pressing force.

In order to achieve the above object, according to one aspect of the present invention, there is provided a fixing device including: a fixing roller which is heated to a predetermined temperature by a heater; a pressure belt which is in pressure contact with the fixing roller; and a pressing part which presses the pressure belt toward the fixing roller, wherein, a toner image formed on a recording medium is fixed to the recording medium by heat and pressure while the recording medium is nipped and conveyed through a nip part formed by the fixing roller and the pressure belt; the pressing part includes a pressing member, a sheet member which covers the pressing surface of the pressing member along a conveying direction of the recording medium, and a pressing fluid which is filled directly between the pressing member and the sheet member, and the nip part includes: an adhesion nip at which the recording medium is nipped through the pressing fluid; and a separation nip at which the recording medium is nipped without using the pressing fluid and which is arranged continuous to a downstream side of the adhesion nip in the conveying direction.

Preferably, according to the above fixing device, a press amount at the separation nip of the pressing member and a press amount at the adhesion nip of the pressing member are individually adjustable.

Preferably, the above fixing device further includes; a fluid distribution control member which presses the sheet member and changes a distribution of the pressing fluid; a driver which moves the fluid distribution control member; and a controller which adjusts the press amount by the pressing part toward the fixing roller by controlling the driver so as to move the fluid distribution control member.

Preferably, according to the above fixing device, the controller controls a press amount at the separation nip of the pressing member and a press amount at the adhesion nip of the pressing member based on a type of the recording medium to be conveyed.

Preferably, according to the above fixing device, the controller separates the pressing part from the fixing roller while a fixation process is not performed.

According to another aspect of the present invention, there is provided an image forming apparatus including the fixing apparatus according to the above aspect.

BRIEF DESCRIPTION OF THE DRAWINGS

The present invention will become more fully understood from the detailed description given hereinbelow and the appended drawings which are given by way of illustration only, and thus are not intended as a definition of the limits of the present invention, and wherein.

DETAILED DESCRIPTION OF THE PREFERRED EMBODIMENT

Embodiment

[1. Description of Configuration]

Hereinafter, an embodiment of the present invention will be described based on the drawings.

In the present embodiment, an example of an image forming apparatus according to the present invention applied to a digital multi-function peripheral (MFP), including the functions of a copier, a printer, and the like, will be described. The image forming apparatus according to the present invention is applied not only to the digital MFP, but also to any apparatus, such as a facsimile apparatus or a single-function apparatus as a copier or a printer, as long as the image forming apparatus forms image performs image formation on paper.

Figure 1:
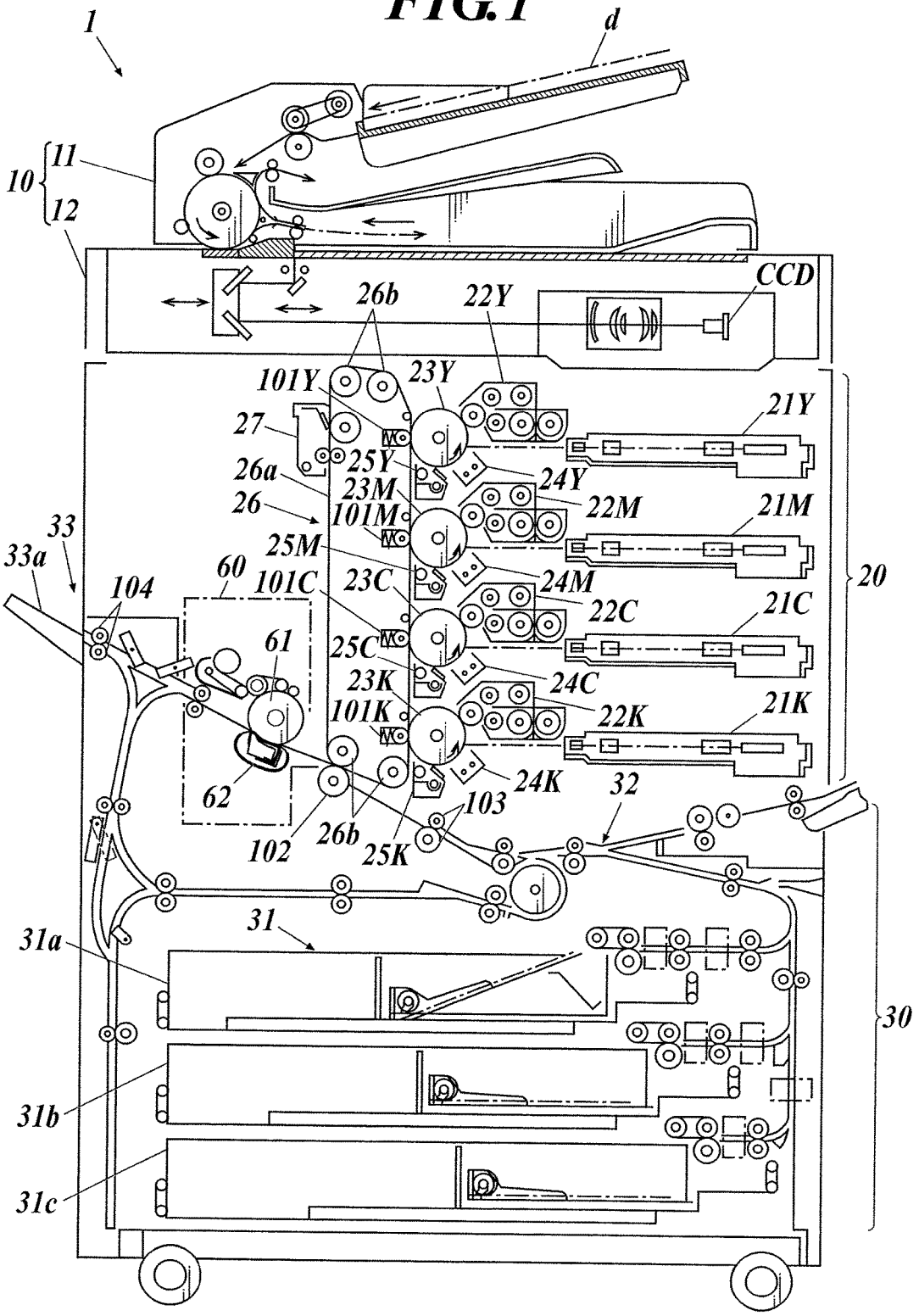
FIG. 1 illustrates the schematic configuration of an image forming apparatus according to an embodiment of the present invention.
Figure 2:
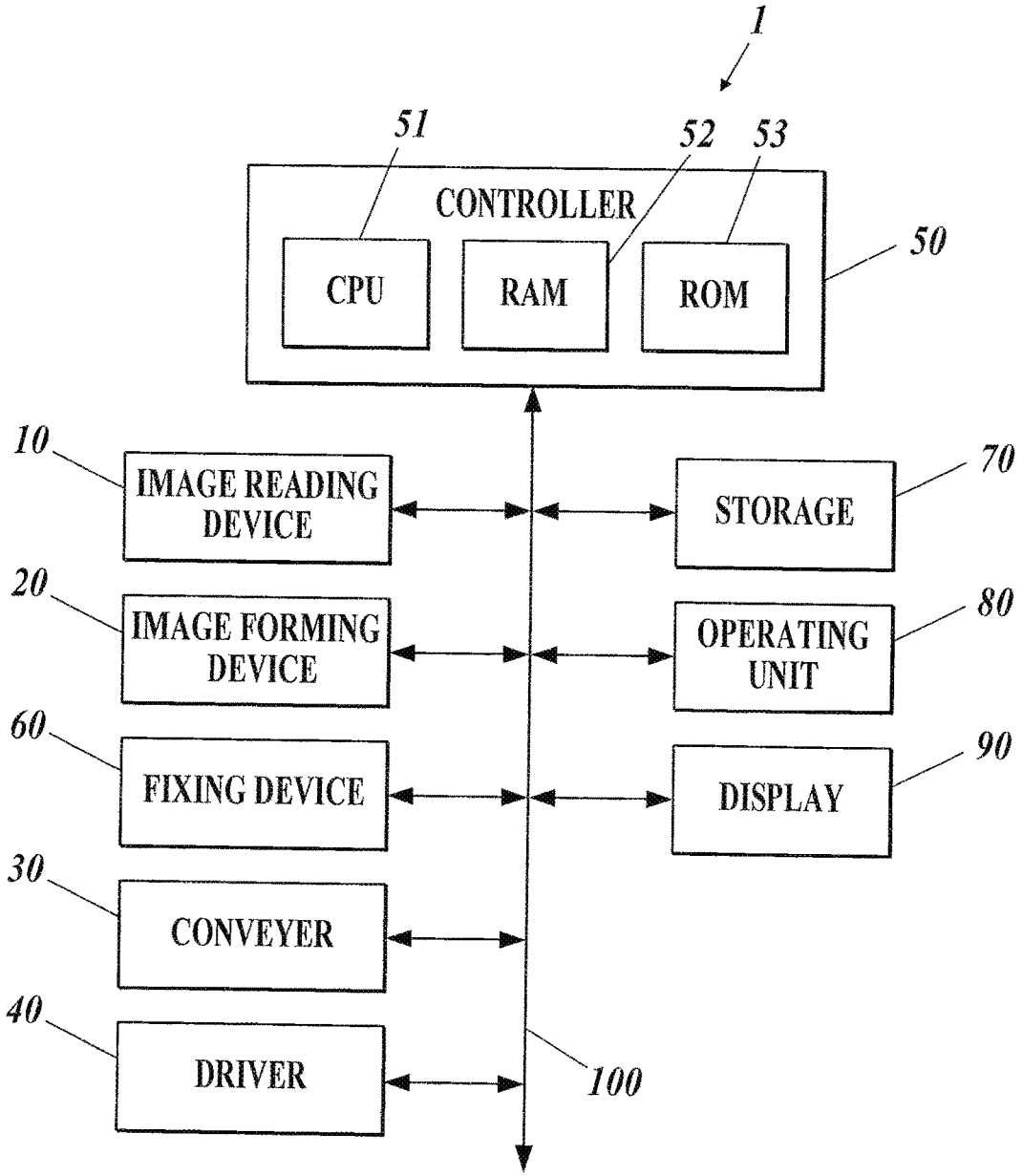
FIG. 2 is a block diagram of the functional configuration of the image forming apparatus illustrated in FIG. 1.

FIG. 1 is a view showing an internal configuration of an image forming apparatus according to the present embodiment. FIG. 2 is a block diagram of the main functional configuration of the image forming apparatus 1.

The image forming apparatus 1 forms an image on paper by superposing colors thereon on the basis of the image data obtained by reading a color image formed on an original or the image data input from an external information equipment (for example, a personal computer) through a network. The image forming apparatus 1 adopts a tandem system by being equipped with photoreceptor drums 23 (23Y, 23M, 23C, 23K) arranged in a row, corresponding to four colors of yellow (Y), magenta (M), cyan (C), black (K), respectively, and by transferring each color toner image sequentially in a set of procedure to form a color image on paper.

As illustrated in FIG. 1, the image forming apparatus 1 is constituted of an image reading unit 10, an image forming unit 20, a conveying unit 30, fixing device 60, and the like.

The image reading unit 10 is constituted of an automatic original paper feeding apparatus 11, which is called an auto document feeder (ADF), an original image scanning apparatus 12, and the like. The automatic original paper feeding apparatus 11 conveys an original D placed on an original tray with a conveyance mechanism to send out the original D to the original image scanning apparatus 12. The original image scanning apparatus 12 performs the light scanning of the conveyed original D and performs the photoelectric conversion of the original image on the original D to read the original image with a charge coupled device (CCD). The image includes text data and the like, such as a character and a sign, besides image data such as a figure and a picture.

The image (the analog image signal) read by the image reading unit 10 is output to a controller 50, described below, and is subjected to various kinds of image processing, such as analog-to-digital (A/D) conversion processing, shading correction processing, and the like. After that, the processed image is subjected to color separation into each color of yellow (Y), magenta (M), cyan (C), and black (K) to be output to the image forming unit 20 as image data to be output.

In addition, the automatic original paper feeding apparatus 11 is configured to be able to consecutively read the images on many originals D (including both sides of the originals D) placed on the original tray at a stretch. The read data of the original images is stored in an internal image memory (not shown) of the image forming unit 20 and is to be sequentially read out as the image data to be output.

The image forming unit 20 is constituted of exposure devices 21 (21Y, 21M, 21C, 21K), development devices 22 (22Y, 22M, 22C, 22K), photoreceptor drums 23 (23Y, 23M, 23C, 23K), charging devices 24 (24Y, 24M, 24C, 24K), cleaning devices 25 (25Y, 25M, 25C, 25K), an intermediate transfer unit 26, a cleaning device 27, and the like.

In the image forming unit 20, the charging devices 24 charge the photoreceptor drums 23, respectively, and the exposure devices 21 radiate lights according to image data of the respective colors to the charged photoreceptor drums 23 to form electrostatic latent images, respectively. The development devices 22 make the respective color toners adhere onto the surfaces of the photoreceptor drums 23, on which electrostatic latent images are formed, respectively, to develop the electrostatic latent images.

The intermediate transfer unit 26 is an endless belt 26*a* (hereinafter referred to as an intermediate transfer belt 26*a*) laid across between supporting rollers 26*b*. The primary transfer rollers 101 (101Y, 101M, 101C, 101K) bring the intermediate transfer belt 26*a* into pressure contact with the photoreceptor drum 23, on which the toners adhere, and perform primary transfers of the respective color toner images onto the intermediate transfer belt 26*a* by sequentially superposing the toner images. The secondary transfer roller 102 brings paper into pressure contact with the intermediate transfer belt 26*a*, on which primary transfers are performed, and performs secondary transfers of the toner images to the paper.

The cleaning devices 25 remove the toners remaining on the surfaces of the photoreceptor drums 23, respectively, after primary transfer. The cleaning device 27 removes the toners remaining on the intermediate transfer belt 26*a* after secondary transfer.

The fixing device 60 adopts the belt-nip system and includes a fixing roller 61, a pressing part 62 equipped with a pressure belt in pressure-contact with the fixing roller 61, and the like. The fixing device adopting the belt-nip system brings the pressure belt into pressure contact with a fixing roller 61 to form a nip part. While nipping and conveying the paper on which the toner images are formed, the toner images are fixed to the paper by heat and pressure at the nip part. The detailed configuration of the fixing device 60 will be described in the following.

The conveying unit 30 is constituted of a paper feeding device 31, a conveyance device 32, a paper ejecting device 33, and the like. The paper feeding device 31 includes three paper feeding tray units 31*a* to 31*c*, each of which houses a kind of standardized paper or special paper that is previously set and identified on the basis of the weight, the size, and the like of paper. The paper housed in the paper feeding tray units 31*a* to 31*c* is sent out sheet by sheet from the uppermost part of the paper feeding tray units 31*a* to 31*c*, and is conveyed to the image forming unit 20 by the conveyance device 32, equipped with a plurality of conveyance rollers such as resistance rollers 103. A tilt of the fed paper is corrected and a conveying timing of the paper is adjusted by the resistance part where the resistance rollers 103 are disposed.

In the image forming unit 20, the toner images on the intermediate transfer belt 26*a* are secondarily transferred collectively on one surface of the paper, and fixation process is performed by the fixing device 60. Then, the paper on which the image is formed is ejected onto a catch tray 33*a* on the outside of the image forming apparatus 1 by the paper ejecting device 33 equipped with paper ejecting rollers 104.

As illustrated in FIG. 2, the image forming apparatus 1 includes a controller 50 that includes a CPU 51 (central processing unit), a RAM 52 (random access memory) and a ROM 53 (read only memory), a storage 70, an operating unit 80, a display 90, a driver 40, and the like. The controller 50 is connected to the storage 70, the operating unit 80, the display 90, and the driver 40 via a bus 22.

The CPU 51 reads out a control program stored in the ROM 53 or the storage 70 and executes it to perform a variety of processing.

The RAM 52 provides a working memory space to the CPU 51 and stores temporary data.

The ROM 53 stores a variety of control programs to be executed by the CPU 51, setting data, and the like. In replace of the ROM 53, a rewritable non-volatile memory such as an EEPROM (electrically erasable programmable read only memory) or a flash memory may be used.

The controller 50 that includes the above-described CPU 51, RAM 52, and ROM 53 integrally controls the components of the image forming apparatus 1 according to the above-described control programs. For example, according to the control by the controller 50, the conveying unit 30 conveys paper and the image forming unit 20 forms an image based on the image data stored in the storage 70.

The storage 70 is constituted of a storing means such as a DRAM (dynamic random access memory), which is a semiconductor memory, and an HDD (hard disk drive). In the storage 70, image data obtained by the image reading unit 10, image data input from the outside via the interface (not shown), and the like are stored. Such image data and the like may be stored in the RAM 52 instead. The operating unit 80, which includes input devices such as operation keys and a touch panel overlaid on a screen of the display 90, converts an operation input on the input devices to an operation signal and outputs it to the controller 50.

The display 90 equipped with a display device such as an LCD (liquid crystal display) displays an operation screen under control of the controller 50 and shows the status of the image forming apparatus 1, operations to be input on the touch panel, and the like.

The driver 40, such as an actuator, moves a fluid distribution control member described below under control of the controller 50.

[1-1. Description of Configuration of Fixing Device]

Figure 3:
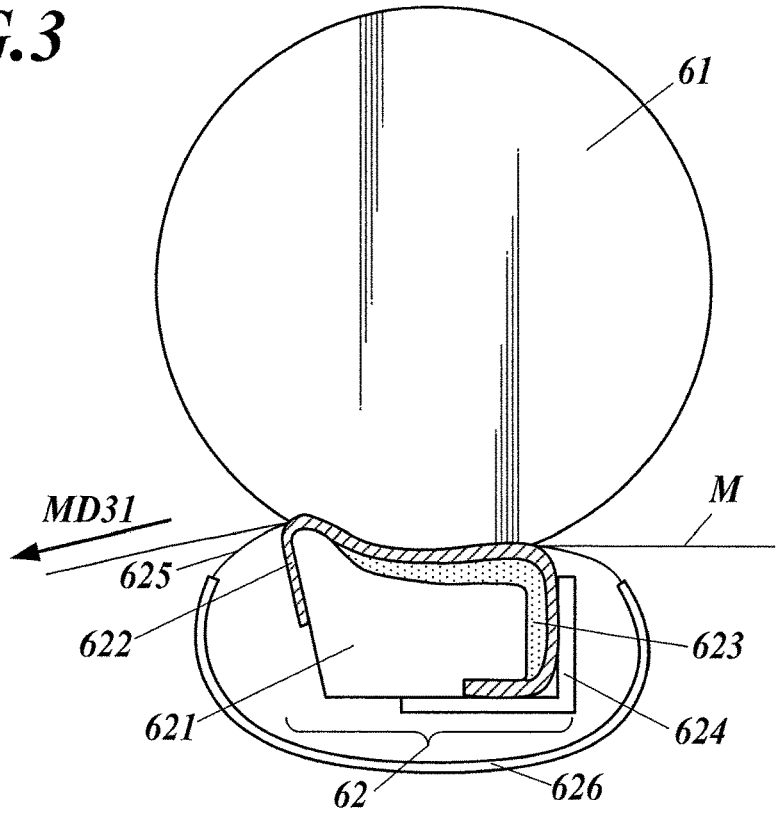
FIG. 3 is an enlarged schematic view of a fixing device.

FIG. 3 is a view illustrating a detailed configuration of the fixing device 60.

As illustrated in FIG. 3, the fixing device 60 is a fixing device adopting the belt-nip system and is constituted of a fixing roller 61, a pressing part 62, and the like.

The fixing roller 61 is constituted of a cylindrical core having the external diameter of 80 mm formed of aluminum coated with 10 mm thick silicone rubber as an elastic layer and further coated with 50 μm thick PFA tube as a release layer, for example. The fixing roller 61 incorporates a halogen heater as a heating unit. A release layer may be further formed on the elastic layer by coating a release agent.

The pressing part 62 is constituted of a pressing member 621, a sheet member 622, which covers the pressing surface of the pressing member 621 along the conveying direction of the recording medium, a pressing fluid 623, which is filled between the pressing member 621 and the sheet member 622, a fluid distribution control member 624, which controls the distribution of the pressing fluid 623 filled between the pressing member 621 and the sheet member 622, and a driver 40, which moves the fluid distribution control member 624.

The pressing surface of the pressing member 621 gently rises toward the conveying direction, so that the pressing member 621 has a maximum separation curvature at a portion where the paper is separated from the pressing member 621. The material to form the pressing member 621 has enough rigidity at the fixing temperature. For example, the material preferably used as the pressing member 621 includes a metal such as aluminum, a heat-resistant resin, and the like.

The sheet member 622 covers the pressing surface of the pressing member 621 along a conveying direction and is fixed to the pressing member 621 directly by adhesion and the like. The material to form the sheet member 622 has enough heat resistance, flexibility, and wear resistance at the fixing temperature. For example, the material preferably used as the sheet member 622 includes a polyimide resin and the like.

The pressing fluid 623 is a stable fluid which does not boil at the fixing temperature. For example, the pressing fluid 623 is preferably a chemically stable liquid such as silicone oil and liquid paraffin. The pressing fluid 623 may be a chemically stable gas such as nitrogen.

The fluid distribution control member 624 is controlled in its position by the driver 40 and thereby controls the distribution of the pressing fluid 623 filled between the pressing member 621 and the sheet member 622. For example, the fluid distribution control member 624 is formed as an L-shaped member and freely movable toward or away from the pressing member 621 while being contacted to the sheet member 622. The distribution of the pressing fluid 623 is controlled by the position of the pressing member 621.

A pressure belt 625 is an endless belt nipped between the fixing roller 61 and the pressing part 62. The pressure belt 625 is supported by a pressure belt supporting member 626 except at the periphery of the fixing roller 61. The pressure belt 625 is, for example, an endless belt constituted of a 70 μm thick polyimide substrate, a 18000ate bsilicone rubber as an elastic layer formed thereon, and a 50 μm thick PFA tube as a release layer further formed thereon.

Figure 4:
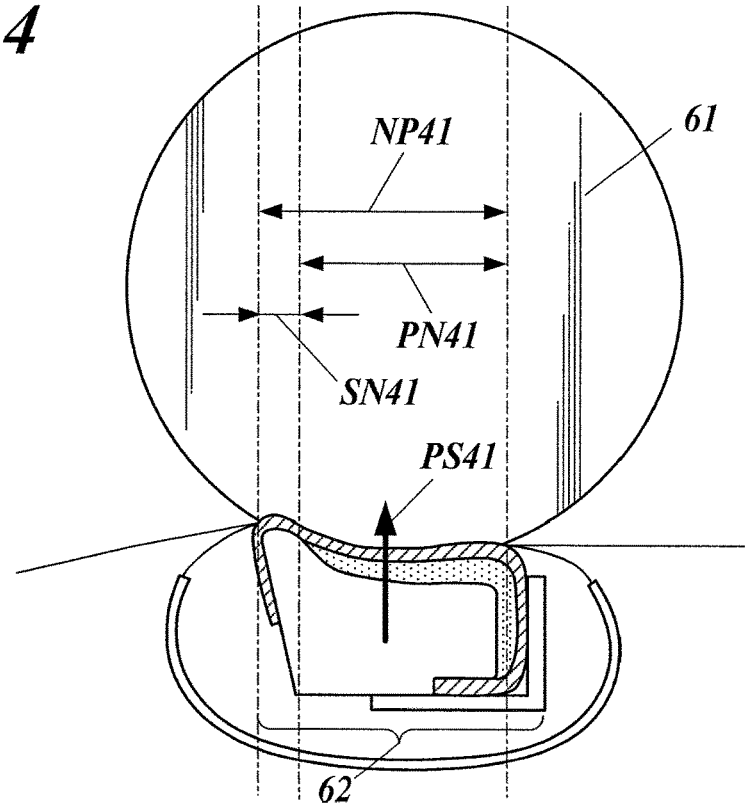
FIG. 4 is an explanatory view illustrating a configuration of a nip part of the fixing device.

As illustrated in FIG. 4, the pressing part 62 presses toward the fixing roller 61 with a pressing force PS41, so that a nip part NP41 for nipping and conveying the paper is formed. The nip part NP41 is composed of a separation nip SN41, at which the pressing fluid 623 is not present between the pressing member 621 and the sheet member 622, and an adhesion nip PN41, at which the pressing fluid 623 is present between the pressing member 621 and the sheet member 622.

In other words, at the separation nip SN41, the pressing fluid 623 is not filled between the pressing member 621 and the sheet member 622. Only at the adhesion nip PN41, the pressing fluid 623 is filled between the pressing member 621 and the sheet member 622.

As illustrated in FIG. 4, the adhesion nip PN41 and the separation nip SN41 are continuously formed and further have the pressing fluid 623 at the boundary between them. Local unevenness of pressing force can be thereby prevented.

Because the pressing fluid 623 is directly filled between the pressing member 621 and the sheet member 622 at the adhesion nip PN41, local unevenness of pressing force does not occur due to a gap formed between the low-friction sheet and the elastic bag which is charged with a heat-resistant liquid in a vacuum condition as described in JP h09-325640A.

[2. Description of Adjustment of Press Amount]

Adjustment of the press amount by the pressing part 62 will be described referring to FIG. 5 and FIG. 6.

Figure 5:
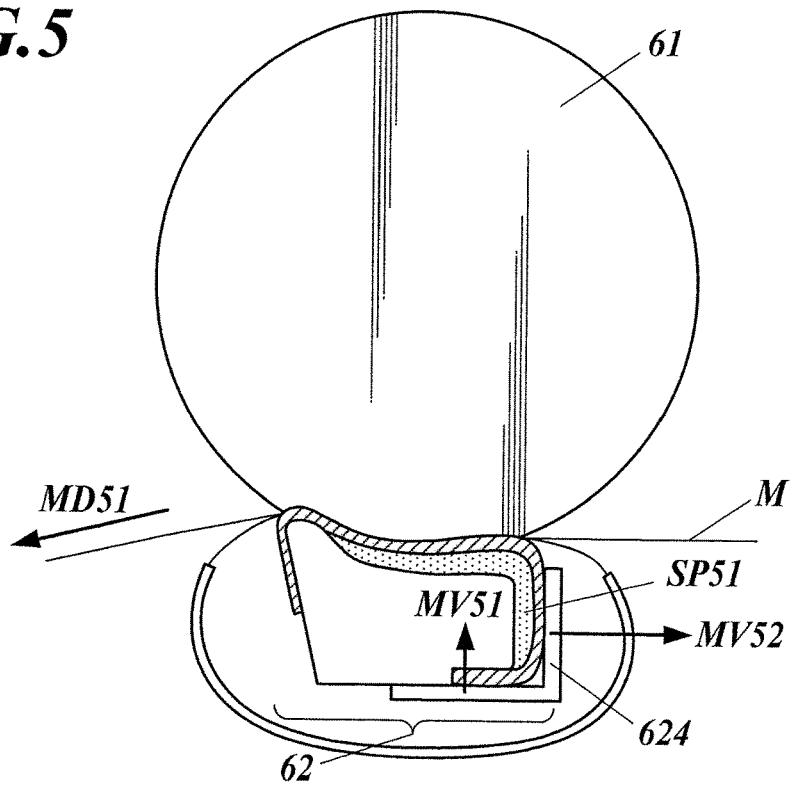
FIG. 5 is an explanatory view illustrating an example of pressing force applied to a fixing roller by a pressing part.

In fixation process of paper which is not easily separated from the fixing device 60, such as thin paper, the driver 40 moves the fluid distribution control member 624 in the direction toward the fixing roller 61 as illustrated in FIG. 5 (for example, in the direction MV51 in FIG. 5) in order to increase the separation curvature at the separation nip SN41.

Here, the driver 40 moves the fluid distribution control member 624 in the direction parallel with and opposite to the conveying direction MD51 (for example, the direction MV52 in FIG. 5) so that the pressing fluid 623 is moved to the direction other than the direction toward the fixing roller 61, in order for the press amount at the adhesion nip PN41 not to become too large.

In other words, the fluid distribution control member 624 is moved in the direction toward the fixing roller 61 and further in the direction parallel with and opposite to the conveying direction, so that the pressing fluid 623 flows into the part SP51. As a result, the curvature at the exit of the separation nip SN41 can be increased and the press amount at the adhesion nip PN41 can be adjusted so as not to become too large.

Figure 6:
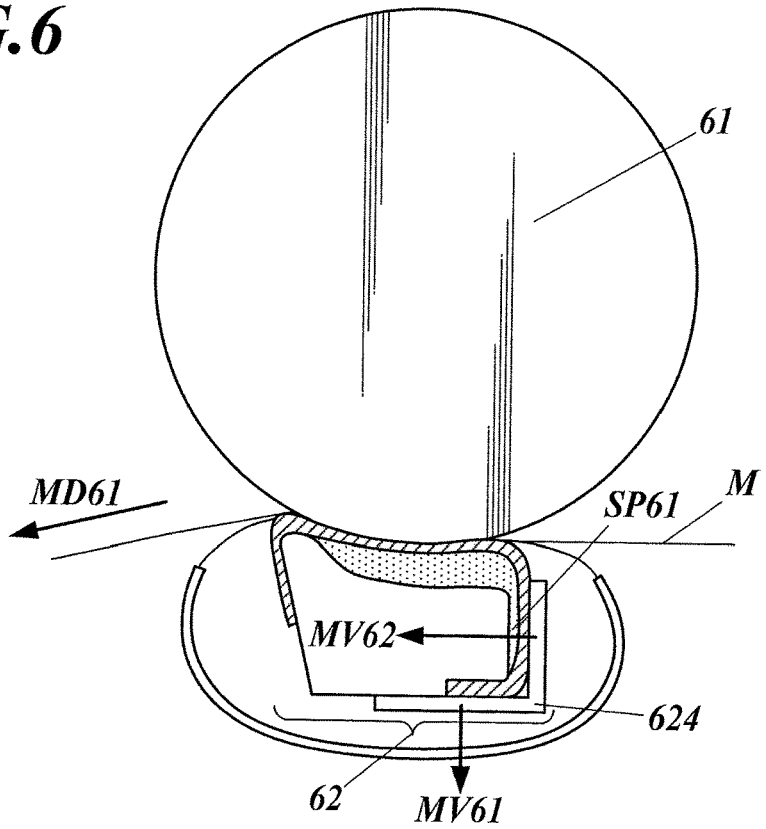
FIG. 6 is an explanatory view illustrating another example of a pressing force applied to a fixing roller by the pressing part.

Meanwhile, in fixation process of paper which is partly different in thickness, such as an envelope, the driver 40 moves the fluid distribution control member 624 in the direction away from the fixing roller 61 as illustrated in FIG. 6 (for example, in the direction MV61 in FIG. 6) in order to minimize deformation of the paper at the nip part NP41 by reducing the press amount by the pressing part 62.

Here, the driver 40 moves the fluid distribution control member 624 in the direction parallel with and same as the conveying direction MD61 (for example, the direction MV62 illustrated in FIG. 6) so that the pressing fluid 623 is not moved to the direction other than the direction toward the fixing roller 61, in order for the press amount at the adhesion nip PN41 not to become too small.

In other words, the fluid distribution control member 624 is moved in the direction away from the fixing roller 61 and further in the direction parallel with and same as the conveying direction, so that the pressing fluid 623 does not flow into the part SP61. As a result, the press amount by the pressing part 62 can be reduced and the press amount at the adhesion nip PN41 can be adjusted so as not to be too small.

[3. Description of Position Control of Fluid Distribution Control Member Based on Paper Type]

Figure 7:
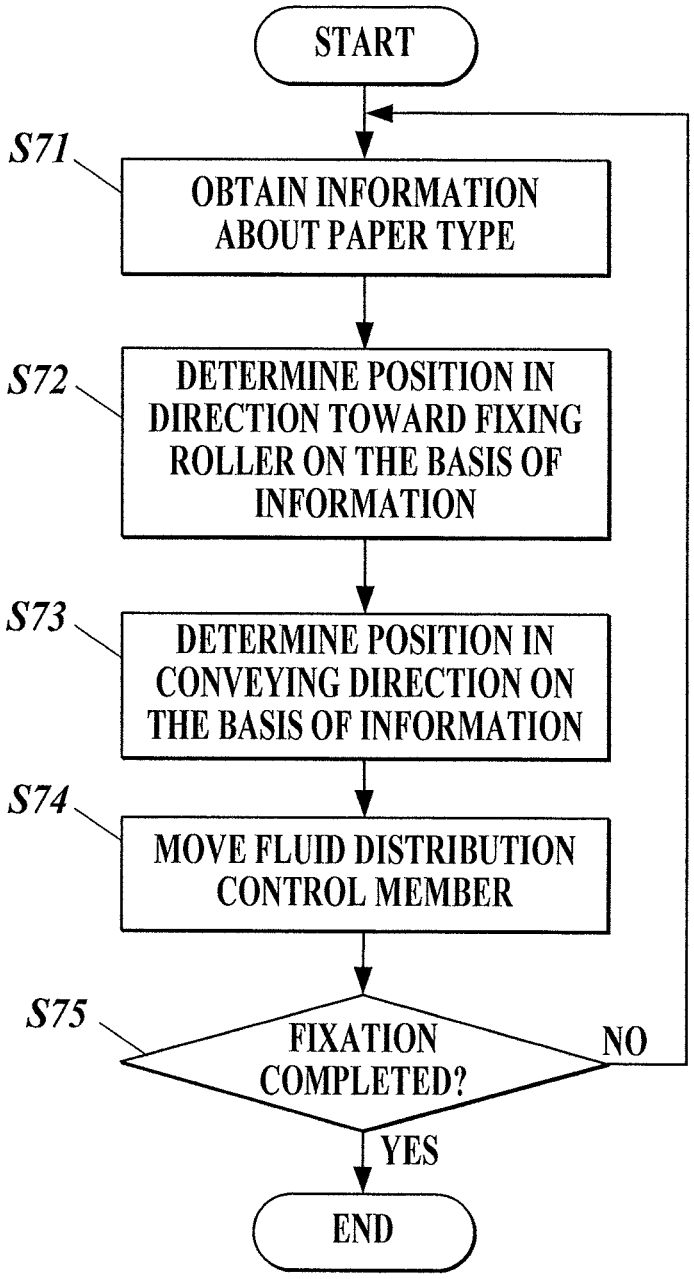
FIG. 7 is a flowchart of an example of the operation of the image forming apparatus.

Position control of fluid distribution control member 624 based on the type of the paper to be fixed will be described referring to FIG. 7 and FIG. 8.

The controller 50 obtains information regarding the type of the paper to be fixed (Step S71). For example, on the basis of the paper feeding tray units 31*a* to 31*c* selected by the conveying unit 30, the controller 50 obtains the information regarding the paper type housed in the paper feeding tray units 31*a* to 31*c*.

The controller 50 determines the position of the fluid distribution control member 624 in the direction toward the fixing roller 61 on the basis of the obtained information regarding the paper type (Step S72), determines the position of the fluid distribution control member 624 in the conveying direction on the basis of the obtained information regarding the paper type (Step S73), and controls the driver 40 in order to move the fluid distribution control member 624 toward the position on the basis of the obtained information regarding the paper type.

Figure 8:
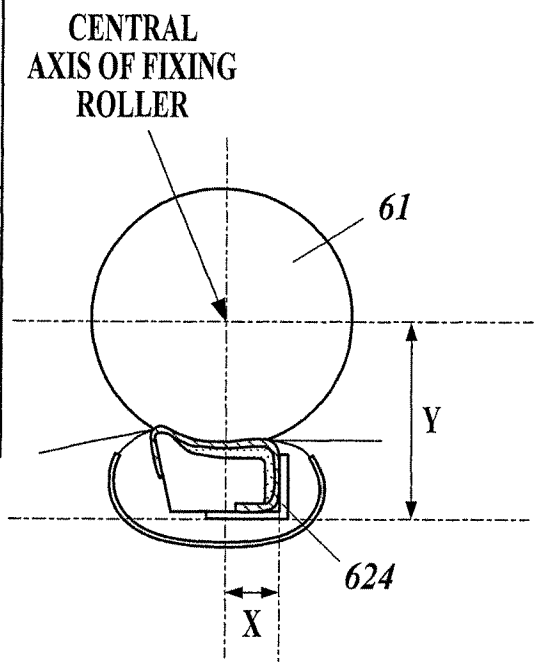
FIG. 8 is an explanatory view illustrating an example showing a relation between paper type and the controlled position of a fluid distribution control member.

As illustrated in FIG. 8, the controller 50 determines the distance (lateral distance X and longitudinal distance Y) between the center axis of the fixing roller 61 and the fluid distribution control member 624 depending on the obtained information of the paper type, specifically, "thin paper", "normal paper", and "thick paper or envelope." The position of the fluid distribution control member 624 illustrated in FIG. 8 is described as position (X, Y), for example.

For example, the position (X1, Y1) for "thin paper", which requires maximum press amount as described above, is considered as a reference. Because "normal paper" requires less press amount than "thin paper", the longitudinal distance Y2 for "normal paper" is longer than the longitudinal distance Y1 for "thin paper" and the lateral distance X2 for "normal paper" is shorter than the lateral distance X1 for "thin paper" as illustrated in FIG. 8.

Furthermore, because "thick paper or envelope" requires less press amount than "normal paper", the longitudinal distance Y3 for "thick paper or envelope" is longer than the longitudinal distance Y2 for "normal paper" and the lateral distance X3 for "thick paper or envelope" is shorter than the lateral distance X2 for "normal paper" as illustrated in FIG. 8.

In other words, the fluid distribution control member 624 is moved in the direction perpendicular to the conveying direction and away from the center axis of the fixing roller 61 and further in the direction parallel to the conveying direction and toward the center axis of the fixing roller 61. As a result, the press amount by the pressing part 62 can be reduced and the press amount at the adhesion nip PN41 is adjusted so as not to be too small.

The pressing part 62 is separated from the fixing roller 61 while the fixation process is not performed, for example. The longitudinal distance Y4 for "separation" is longer than the longitudinal distance Y3 for "thick paper or envelope" as illustrated in FIG. 8. Of course, the longitudinal distance Y4 for "separation" is long enough to separate the pressing part 62 from the fixing roller 61.

The lateral distance X4 for "separation" is longer than the lateral distance X1 for "thin paper", so that the pressing fluid 623 easily flows into the part SP51 in FIG. 5. The press amount at the adhesion nip PN41 is thereby significantly reduced, so that the pressing part 62 easily separates from the fixing roller 61.

Finally, the controller 50 judges whether to finish the fixation process or not (Step S75). If the controller 50 judges that the fixation process finishes (Step S75, Yes), the pressing part 62 is moved to the position to separate from the fixing roller 61 and finishes fixation processing. If the controller 50 judges that the fixation process does not finish (Step S75, No), the process returns to Step S71.

As described above, local unevenness of the pressing force PS41 can be prevented by the pressing part 62 constituted of a pressing member 621, the sheet member 622, which covers the pressing surface of the pressing member 621 along the conveying direction of the paper, and the pressing fluid 623, which is filled in the adhesion nip PN41 between the pressing member 621 and the sheet member 622.

In the above embodiment, the sheet member 622 covers the pressing surface of the pressing member 621 along the conveying direction of the paper. Instead, a tubular sheet member may cover the entire pressing member 621.

Figure 9:
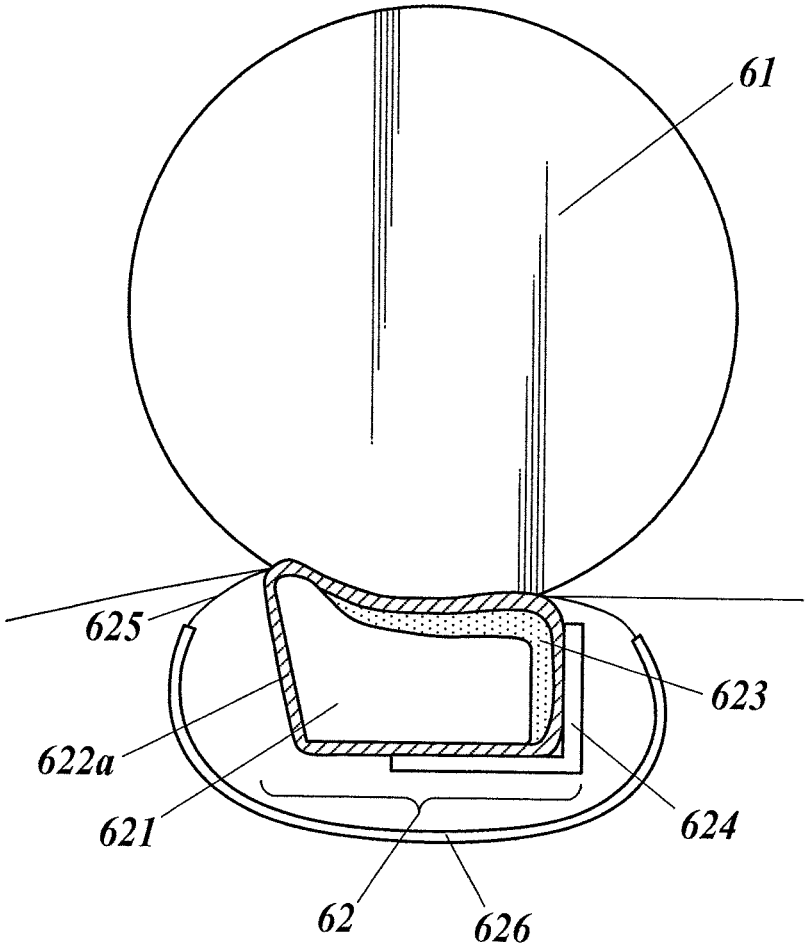
FIG. 9 is an enlarged schematic view illustrating another fixing device.

For example, as illustrated in FIG. 9, a tubular sheet member 622*a* covers the entire pressing member 621, and both ends of the tube are sealed. This makes the formation of the pressing part 62 easy and surely prevents leakage of the pressing fluid 623 due to poor adhesion at the end of the sheet member 622*a*.

In the above embodiment, unnecessary abrasion of the sheet member 622 and heating of pressing fluid 623 can be prevented and the life of the pressing member 62 is thereby prolonged, because the pressing part 62 is separated from the fixing roller 61 while the fixation process is not performed.

In the embodiment, the image forming apparatus 1 includes image forming units respectively for the colors of Y (yellow), M (magenta), C (cyan), and K (black), and an color image is formed on the paper. However, this configuration is merely an example, and the image forming apparatus may be configured to form a monochromatic image.

In the embodiment, paper is used as a recording medium, however, the recording medium is not limited to paper, but may be constituted by any sheet material on which a toner image can be formed and fixed. For example, recording medium may be nonwoven fabric, plastic film, leather and the like.

This U.S. patent application claims priority to Japanese patent application No. 2016-104763 filed on May 26, 2016, the entire contents of which are incorporated by reference herein for correction of incorrect translation.

What is claimed is:

1. A fixing device comprising:

a fixing roller which is heated to a predetermined temperature by a heater;

a pressure belt which is in pressure contact with the fixing roller; and a pressing part which presses the pressure belt toward the fixing roller, wherein:

a toner image to be formed on a recording medium is fixed to the recording medium by heat and pressure while the recording medium is nipped and conveyed through a nip part formed between facing surface regions of the fixing roller and the pressing part, the pressing part comprises a pressing member, a sheet member which covers a pressing surface of the pressing member along a conveying direction of the recording medium, and a pressing fluid which is filled directly between the pressing member and the sheet member, and the nip part comprises:

an adhesion nip at which the recording medium is nipped through the pressing fluid; and a separation nip at which the recording medium is nipped without using the pressing fluid and which is arranged continuous to a downstream side of the adhesion nip in the conveying direction.

2. The fixing device according to claim 1, wherein a press amount at the separation nip of the pressing member and a press amount at the adhesion nip of the pressing member are individually adjustable.

3. The fixing device according to claim 1, further comprising:

a fluid distribution control member which presses the sheet member and changes a distribution of the pressing fluid;

a driver which moves the fluid distribution control member; and a controller which adjusts a press amount by the pressing part toward the fixing roller by controlling the driver so as to move the fluid distribution control member.

4. The fixing device according to claim 3, wherein the controller controls a press amount at the separation nip of the pressing member and a press amount at the adhesion nip of the pressing member based on a type of the recording medium to be conveyed.

5. The fixing device according to claim 3, wherein the controller separates the pressing part from the fixing roller while a fixation process is not performed.

6. An image forming apparatus, comprising the fixing device according to claim 1 and fixing a toner image onto a recording medium by the fixing device.

7. An image forming apparatus, comprising the fixing device according to claim 2, and fixing a toner image onto a recording medium by the fixing device.

8. An image forming apparatus, comprising the fixing device according to claim 3, and fixing a toner image onto a recording medium by the fixing device.

9. An image forming apparatus, comprising the fixing device according to claim 4, and fixing a toner image onto a recording medium by the fixing device.

10. An image forming apparatus, comprising the fixing device according to claim 5, and fixing a toner image onto a recording medium by the fixing device.

11. The fixing device according to claim 1, wherein both the adhesion nip and the separation nip are within a region where the pressing part and the fixing roller face each other.

* * * * *